United States Patent [19]

Gerding

[11] 4,456,417

[45] Jun. 26, 1984

[54] METHOD AND APPARATUS FOR ALIGNING, SUPPORTING, AND TRANSPORTING HOLLOW CYLINDERS

[75] Inventor: Charles C. Gerding, Pittsburgh, Pa.

[73] Assignee: Jones & Laughlin Steel Corporation, Pittsburgh, Pa.

[21] Appl. No.: 422,513

[22] Filed: Sep. 22, 1982

Related U.S. Application Data

[63] Continuation of Ser. No. 166,656, Jul. 7, 1980, abandoned.

[51] Int. Cl.[3] ..... B22D 41/08

[52] U.S. Cl. ..... 414/22; 414/786; 414/27; 294/95; 164/363

[58] Field of Search ..... 414/745, 748, 786, 908, 414/910, 103, 22, 27; 294/95, 97; 164/119, 129, 133, 363; 29/433

[56] References Cited

U.S. PATENT DOCUMENTS

| | | | |
|---|---|---|---|
| 1,166,284 | 12/1915 | Vroman | 294/95 |
| 1,757,549 | 5/1930 | Smith et al. | 164/129 |
| 2,478,960 | 8/1949 | Wilkie | 294/97 |
| 2,728,600 | 12/1955 | Gray et al. | 294/97 |
| 2,841,300 | 7/1958 | Berquist | 294/97 |
| 3,030,483 | 4/1962 | Rudolph et al. | 294/95 |
| 3,929,184 | 12/1975 | Reuter et al. | 164/363 |

*Primary Examiner*—Trygve M. Blix
*Assistant Examiner*—Stephen P. Avila

[57] ABSTRACT

Method and apparatus are provided for loading, in stepwise fashion, hollow cylinders on a recumbent positioned mandrel, for retaining the cylinders on the mandrel during transfer for vertical positioning, and for releasing the cylinders on a seat without disturbing the linear alignment of or dropping the cylinders.

11 Claims, 5 Drawing Figures

METHOD AND APPARATUS FOR ALIGNING, SUPPORTING, AND TRANSPORTING HOLLOW CYLINDERS

This application is a continuation of application Ser. No. 166,656, filed July 7, 1980 abandoned.

BACKGROUND OF THE INVENTION

1. Field of the Invention

This invention relates to method and apparatus for facilitating the aligning of a series of hollow cylinders in axial array, retaining of the axial array during transport, and releasing of the cylinders without disrupting the axial array. The invention more particularly relates to method and apparatus for facilitating the arranging of refractory tile in axial alignment at a site away from the site of use, retaining the alignment of the tiles while being transported to the site of use, and placing the tile in a vertical stack at the site of use.

2. Description of Prior Art

The known are of arranging refractory tile for use in bottom pour casting systems comprises tedious tasks, e.g., stacking the tiles in situ and threading a protective casing over the positioned stack; or arranging the tile in sub-assembly sections of the protective casing and transferring the assembled casing to the site for use there.

SUMMARY OF THE INVENTION

The present invention provides methos and apparatus for arranging relatively heavy cylinders in axial alignment in a facile manner at a site away from the one of use and whereby the aligned cylinders may be transported to the site of use and positioned as a vertical stack. The invention provides a method for loading tile on a mandrel in step-wise fashion while the mandrel is in a recumbent position, retaining the tile in aligned position while the mandrel is transported, and releasing the tile while it is in a vertical stacked position. The invention is particularly adapted for use in conjunction with bottom-pour metal casting systems wherein ingot molds are fed with metal through a refractory tile lined pouring tube.

According to the present invention, there is provided a mandrel on which refractory tile may be loaded while the mandrel is in a recumbent position to facilitate handling by the worker loading the tile. The support means for the mandrel is such that the individual tiles may be threaded on and advanced along the mandrel in step-wise fashion without the necessity of having the entire mandrel suspended in cantilever fashion. The mandrel also serves as a carrier for the tile during transport to the site of use, i.e., the pouring station of the casting system. In addition to its own weight, the mandrel must be capable of supporting the weight of the tile, usually in excess of 200 pounds. The height of the refractory tile in the pouring tube is generally over ten feet. The fact that the mandrel need not be supported in a completely cantilevered position means that the strength and the weight of the mandrel may be reduced and made more manageable from a handling standpoint. The mandrel assembly includes support means at its unloading end which complements the mandrel recumbent position supporting means and which also serves as position locating means at the pouring station. A further feature of this invention is the provision of releasable retention means at the unloading end of the mandrel for selectively retaining the tile on and releasing it from the mandrel.

BRIEF DESCRIPTION OF THE DRAWING

Preferred embodiments of the invention are illustrated in the drawing, wherein.

DETAILED DESCRIPTION

Figure 1:
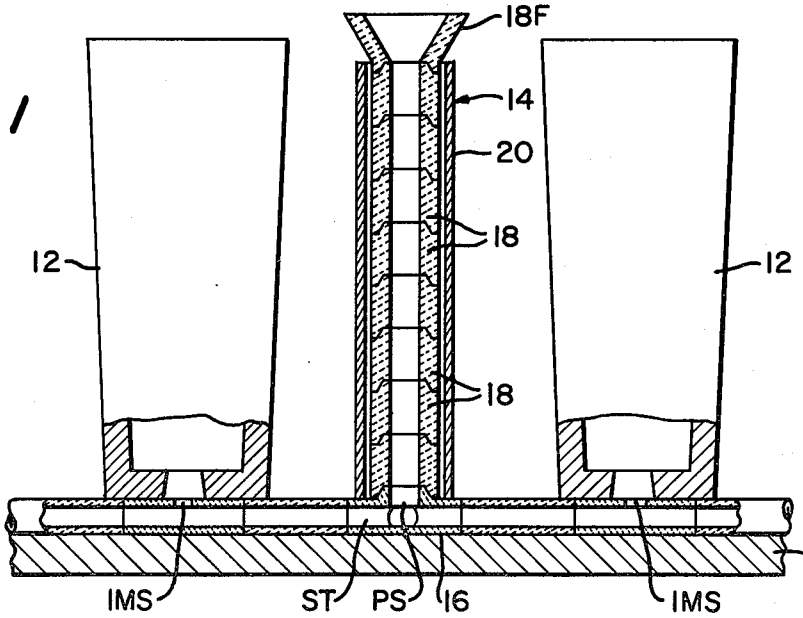
FIG. 1 is a side elevational view of a bottom-pour ingot casting system.

The apparatus disclosed in the drawing performs functions useful in forming a refractory lined upstanding runner or feed tube for use in a bottom-pour metal casting system. Hence, the invention will be described in that connection.

FIG. 1 illustrates a conventional mold stool or base 10 having a plurality of ingot mold stations IMS over which are placed a plurality of ingot molds 12 and a pouring tube or upstanding runner 14 which forms a fountain for the molds 12. Although only two mold stations are shown there is generally a greater number. A manifold runner system 16 extends from the lower end of the pouring tube 14 to the molds 12. The upstanding runner 14 is formed of a plurality of refractory tiles 18 surrounded by a metal casing 20. The space between the tiles 18 and casing 20 may be suitably filled with packing material, preferably of a pourable and insulating type, such as dry sand.

In a known prior art practice, the tiles 18 are stacked in-situ and the casing 20 is tediously and carefully placed over the precarious stack. It is pointed out again that the upstanding runners or pouring tubes 14 usually extend upwardly in excess of ten feet and that the stack formed by the refractory tubes may weigh over 200 pounds.

The present invention relates to method and apparatus whereby the stack of tiles may be preassembled in a more convenient and expeditious manner and thereby effect savings in both time and costs.

Figure 2:
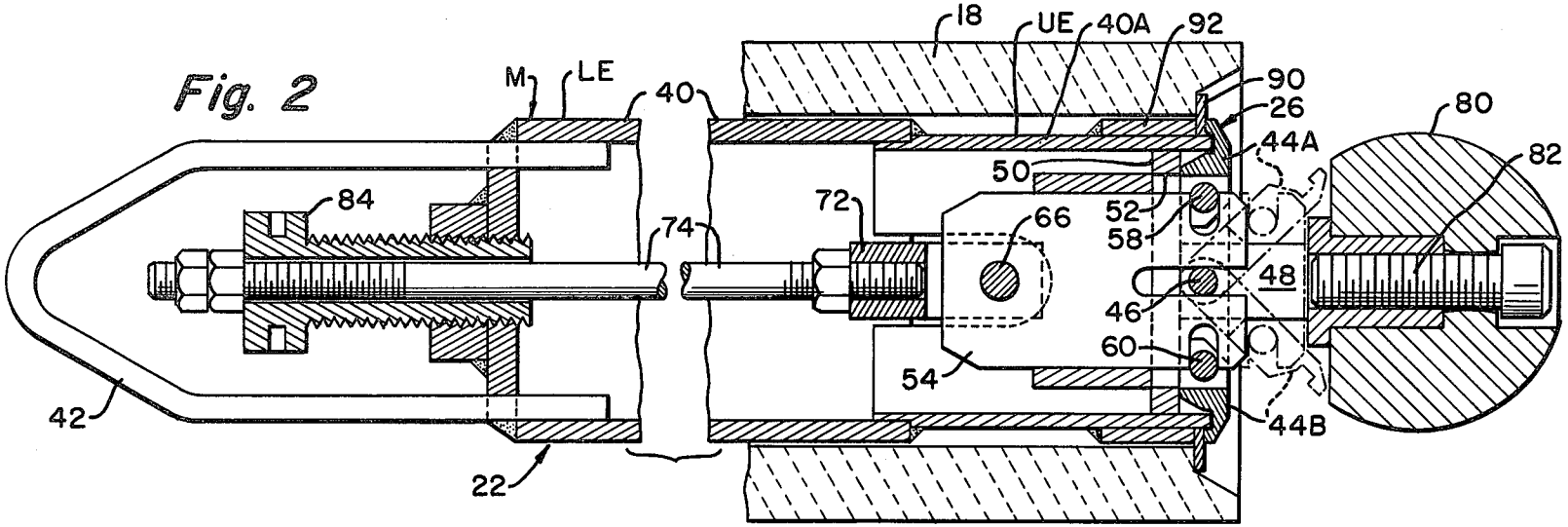
FIG. 2 is a cross-sectional side elevational view of a threading and positioning mandrel forming a part of this invention.
Figure 3:
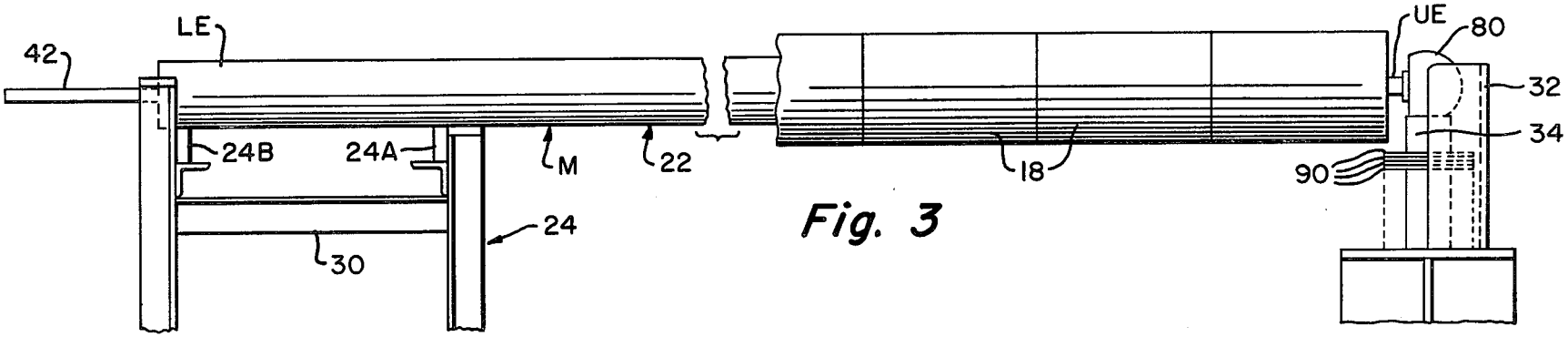
FIG. 3 is a side elevational view of the mandrel of FIG. 2 shown in a recumbent loading position on support means which also form a part of this invention.

The apparatus as illustarated in FIG. 2 generally comprises a mandrel 22 upon which the tiles 18 may be threaded in step-wise fashion while the mandrel 22 is in a recumbent position as shown in FIG. 3; support means 24 for supporting one end of the mandrel in the recumbent position while the tiles are loaded on the mandrel; retention means 26 (FIG. 2) for selectively retaining and releasing the tiles on and from the mandrel; and fastening means 42 whereby the tile loaded mandrel 22 may be fastened to lifting means, hoisted and positioned at a pouring station PS of base 10.

Figure 4:
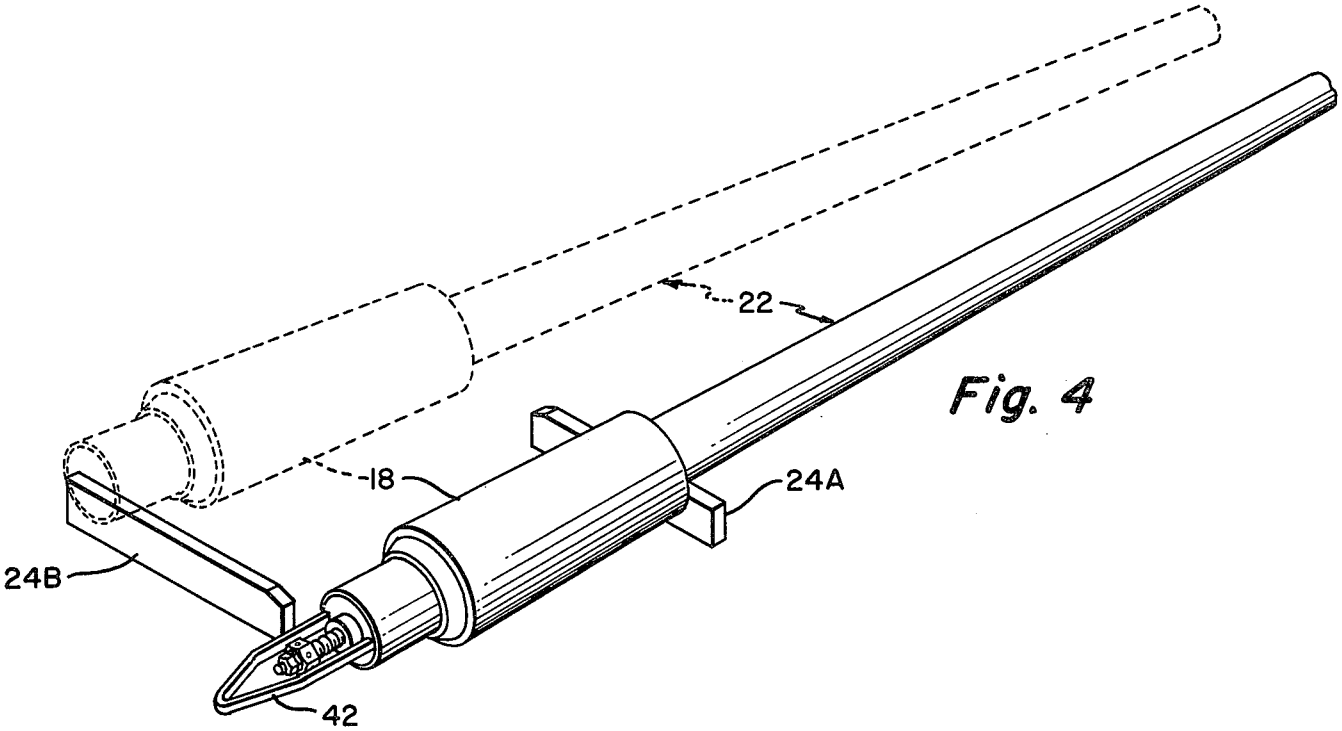
FIG. 4 is a fragmentary three dimensional view of the mandrel and support means of FIG. 3 with the mandrel and a first tile shown in the tile loading position by solid lines and the mandrel in an advancing position shown in phantom lines with the first tile ready for advancement along the mandrel.
Figure 5:
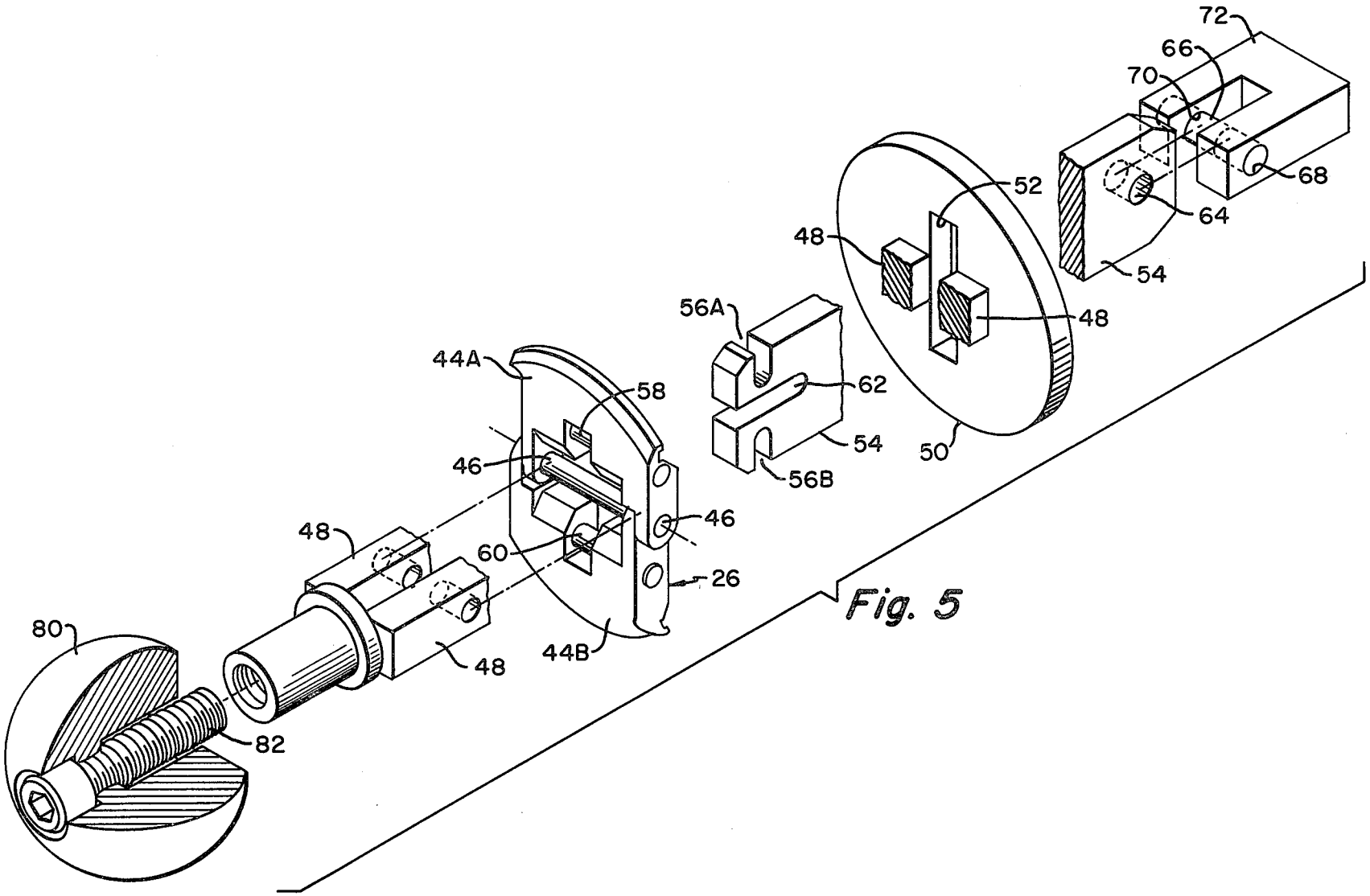
FIG. 5 is an "exploded" pictorial view of the principal elements of the retention means and retention end of the mandrel.

The apparatus comprises support means 24 for supporting the mandrel 22 in a recumbent but elevated position for the convenience of the person who loads the tiles 18 on the mandrel 22. The support means 24 comprises first means at the loading end LE of the mandrel, shown to be in the form of a first bar 24A mounted on table 30, for supporting a portion of the loading end in cantilever position so that the mandrel 22 will be open to receive one or more tiles 18 while in the loading position; second means, also at the loading end of the mandrel 22, shown to be in the form of a second bar 24B in spaced apart relation to the first bar 24A and arranged in relation to the first bar 24A whereby one or more tile positioned on the mandrel 22 while in the cantilevered or first position may be advanced along the mandrel 22 past the first bar 24A when the mandrel 22 is in the second position, shown in FIG. 4.

In FIG. 3 there is also shown third support means 32 which is located at the opposing or unloading end UE of the mandrel 22. In a preferred form, for reasons to be hereinafter described more fully, the third support means includes a socket portion 34 forming part of a ball and socket arrangement with the ball portion 80 at the end of the mandrel 22. The socket 34 facilitates shifting of the mandrel 22 from its tile loading position to its tile advancement position and the removal of the tile loaded mandrel from the support means.

The mandrel assembly generally designated by the reference M includes a tube 40 forming a basic part of the mandrel, a handle 42 at the loading end of the mandrel 22, which handle 42 tile loader personnel may grasp to roll or shift the mandrel from the loading position to the advancing position and vice versa. Also, the handle 42 when in the form of an eye provides means by which the mandrel assembly M may be lifted by the hook (not shown) of a hoisting mechanism, such as a crane, for positioning at the pouring station PS.

At the opposing or unloading end UE of the mandrel assembly M is retention means shown to be in the form of a pair of selectively actuable bifurcated gripping jaws 44A and 44B hinged together by pintle 46 extending through and supported by clevis 48. The clevis is fixedly secured to transverse wall 50 of the tube 40. Actuating means in the form of a cam member 54 extends through slot 52 of wall 50. Camming slots 56A and 56B are provided to mate with pins 58 and 60, respectively. Slot 62 in cam 54 is provided and sized to avoid interference with pintle 46. The opposing end of member 54 is provided with connecting means in the form of pin 66 extending through hole 64 of cam 54 and holes 68 and 70 of clevis 72. Clevis 72 is suitably secured to actuating rod 74 which extends from the loading end LE of mandrel 22 toward the retention and unloading end UE.

At the unloading end UE of the mandrel 22 there is provided positioning means shown to be in the form of a fragmentary ball 80 secured to clevis 48 by means of threaded bar 82. The ball 80 forms part of the ball and socket arrangement previously referred to as forming the third support means. The ball shape is preferred for the reason that it facilitates positioning of a tile loaded mandrel at the pouring station because the ball can be suitably positioned in the round hole of the refractory tile which defines the entrance into the runner system 16 leading to the ingot mold stations. The ball shape also facilitates handling during the lowering of the empty mandrel by the crane from a vertical position with ball 80 in engagement with socket 34 to a recumbent position when the loading end LE of the mandrel rests on support means 24. It likewise facilitates the raising of the loaded mandrel by the crane from the recumbent to the vertical position.

In operation, a retaining washer 90, from a stack mounted over the socket 34, is threaded over the ball 80 and is seated against the edge of fixed ring 92 which is part of mandrel 22 so that it encircles the mandrel and lies in front of the gripping jaws 44A and 44B when the jaws are in release position. The actuating rod 74 is pulled forward by threading the nut 84 at the loading end of the mandrel causing the sidewalls defining slots 56A and 56B in cam member 54 to engage pins 58 and 60 and pull jaws 44A and 44B in retention position wherein they engage washer 90 and cause it to bear tightly against the end face of mandrel tube 40 formed by ring 92. The washer 90 is preferably dimensioned such that its inside diameter is less than the outside diameter of mandrel tube 40 but is slightly greater than the outside diameter of a centering boss in the form of tube extension 40A. Its outside diameter is greater than the outside diameter of mandrel tube 40 and the inside diameter of tile 18. Usually, the bottom end face of the refractory tiles 18 used in recessed to complement the upstanding ends (having portions of decreased outside diameters) of the next lower positioned tile and thereby provide rabbet joints between the tiles. In such case the washer 90 is positioned against the recessed face of the lowermost tile and its outside diameter is somewhat smaller than the local diameter of the recess in the tile.

The jaw operating functions of the actuating means comprising the cam block 54 and the rod 74 are the result of the movement of the rod 74 toward and away from the unloading end UE of the mandrel assembly 22. When the cam block 54 is advanced by rod 74 toward the unloading end, and with the pintle 46 being fixed, the jaws will hinge about pintle 46 and will then be in an open position, i.e., a non-retention or releasable position and wherein the gripping edges of jaws are sufficiently displaced from being normal to the longitudinal axis of the mandrel that the normal extent of the jaws in respect to the longitudinal axis is foreshortened enough to permit the jaws and the mandrel assembly to be withdrawn through the inwardly projecting inside diameter of washer 90 and the mounted refractory tiles without disrupting their alignment.

Conversely, when the cam block 54 is drawn away from the unloading end, the jaws will hinge about pintle 46 to a closed or gripping position, i.e., one wherein the gripping edges of the jaws are essentially normal to the axis of the mandrel and in contact with washer 90 which bears against the first tile. Washer 90 is thus releasably attached to mandrel 22. In a less preferred embodiment, the washer 90 is omitted and the gripping jaws bear against an end surface of the tile.

With the ball 80 in socket 34 and the tube 40 resting on support bar 24A, a tile 18 is positioned on the cantilevered portion of tube 40. The mandrel 22 is then pivotably shifted about socket 34 onto bar 24B. The tile 18 is then advanced along the tube 40 toward the unloading end and subsequently caused to bear against washer 90 which is held by jaws 44A and 44B in the closed position. The tube 40 is pivotably shifted back to the loading position onto support bar 24A in readiness to receive the next tile 18. Additional tiles 18 are threaded on and advanced along the tube 40 in like fashion until the desired number are positioned thereon. Now the loaded mandrel 22 is in readiness to be hoisted from the recumbent position by suitable hoisting means, which in most cases because of the great weight of the loaded mandrel will be a crane. The hook (not shown) of the crane apparatus is inserted into the eye member 42 at the loading end and the loaded mandrel 22 is lifted and transferred to the pouring station PS. There the loaded mandrel 22 is lowered and positioned such that the ball 80 enters the upstanding portion of the spider tile ST defining the entrance to the lateral runner system. The weight of mandrel 40 now rests on the inwardly protruding portion of washer 90 which in turn rests on the top of the upstanding portion of tile ST. As the nut 84 is loosened the weight of the rod 74 will cause it to drop. The nut 84 is loosened sufficiently to cause the walls defining the cam slots 56A and 56B to move pins 58 and 60 and cause the gripping jaws to hinge about pintle 46. The complete mandrel assembly is then pulled upwardly leaving the expendable washer 90 (lifting ring) and the stack of tile. At this time the usually employed funnel brick 18F which surmounts the stack of tile can be added. It should be particularly noted here that one of the advantages of the system is that the stack of tiles once seated will rest directly on the top of the spider tile and hence will not be dropped during the jaw releasing operation. Thus, the danger of disrupting the stacked relationship of the tiles is minimized.

It is emphasized here that the element 90 is expendable and remains with the stack of tile at the pouring station PS. Since the inside diameter of element 90 is slightly smaller than the inside diameter of the tile, a slight restriction is formed in the downward passage of the pouring tube, however, such restriction has but a slight effect on the pouring operation. Perferably, the element 90 is comprised of a metal which is compatible with the composition of the metal that is being poured. Generally, the portion of the element 90 which protrudes into the downward passage will melt early in the stage of pouring and any metal that seeps into the juncture between the lowermost tile 18 and the spider tile ST will solidify against the remaining portion of the washer which provides a small absorptive heat capacity in the juncture and deters leakage of the metal being poured.

While the invention has been described above in conjunction with a preferred method wherein the mandrel 22 is supported with the fastening and hoisting means 42 at the end where the support means 24 are located, it will be understood that the mandrel 22 may be turned end-for-end, i.e., with the unloading end UE being supported by the support means 24. In such event, the third support means at the opposing end of the mandrel would be modified to support the mandrel in a manner which would permit shifting of the mandrel between the loading and advancing positions. One such means includes a pivotable saddle for the mandrel.

From the foregoing description it will be seen that the present invention provides tile loading apparatus, useful for positioning tile in linear alignment and transporting the tile to a pouring station of a bottom-pour metal casting system, which apparatus comprises: a mandrel; first mandrel supporting means for supporting the mandrel at the loading end while in a first recumbent position whereby the end is readily accessible for loading; second mandrel supporting means for supporting the mandrel at the loading end in a second recumbent position, wherein the tile may be advanced along the mandrel; third mandrel supporting means for supporting the unloading end of the mandrel in a manner whereby the mandrel may be shifted between the first and second recumbent positions; and releasable retention means at the unloading end of the mandrel for selectively retaining the tile on the mandrel. In a more preferred embodiment, an expendable washerlike element is included, the internal diameter of which is somewhat smaller than the internal diameter of the tile to provide extra bearing support means between the retention means and the tile, and to avoid the necessity of dropping the stack of refractory tile by some finite amount since the thickness of the washer stays in the stack.

What is claimed is:

1. A method of loading hollow cylinders on a mandrel which comprises the steps of:

(1) threading a cylinder over a cantilevered end portion of said mandrel which is in a first recumbent position;

(2) shifting said mandrel with said cylinder thereon to a second recumbent position;

(3) advancing said cylinder along said mandrel to a portion thereof away from that portion which was cantilevered when said mandrel was in said first recumbent position;

(4) returning said mandrel to said first recumbent position for readiness to receive an additional cylinder; and (5) repeating steps (1) through (4) until the desired number of cylinders are loaded on said mandrel.

2. A method of forming an upstanding stack of hollow cylinders, which comprises the steps as described in claim 1 and the additional steps of:

(6) lifting the mandrel with the cylinders being retained thereon by retention means carried by said mandrel and positioning the mandrel at the site of use of said cylinders;

(7) releasing the retention action of said retention means; and (8) withdrawing said mandrel while leaving said cylinders deposited in an upstanding stack.

3. A method as described in claim 2, which comprises:

(9) interposing a dispensable load bearing element between the lowermost cylinder and said retention means; and

(10) leaving said element deposited as part of said stack.

4. Cylinder loading apparatus comprising, in combination:

(1) a cylinder loadable mandrel;

(2) first mandrel support means for supporting said mandrel at one end thereof in a first recumbent position and in a manner whereby a cylinder may be threaded thereon;

(3) second mandrel support means for supporting said mandrel at said one end thereof in a second recumbent position and in a manner whereby said cylinder may be advanced along said mandrel;

(4) third mandrel support means for supporting said mandrel at its end opposite to said one end and in a manner whereby said mandrel may be shifted between said first and said second positions;

(5) selectively releasable retention means at said opposite end of said mandrel for selectively retaining tile on said mandrel when in a retention position and being actuable to permit said mandrel to be withdrawn from said tile.

5. Apparatus as described in claim 4, wherein said releasable retention means includes:

a pintle;

bifurcated jaw means hinged on said pintle; and slide cam means for actuating said jaw means between cylinder retention and cylinder releasable positions.

6. Apparatus for positioning refractory tiles in linear alignment and transporting said tile to a pouring station of a bottom casting system, comprising:

(1) a mandrel for receiving thereon said tiles in threaded fashion;

(2) first support means for supporting a first end of said mandrel in a first position wherein a portion of said mandrel extends in cantilever fashion to receive at least one of said tiles;

(3) second support means for supporting said first end of said mandrel in a second position, said second support means being in spaced apart relation with said first support means and arranged in a relationship whereby the tile positioned on the cantilever portion of the mandrel at the first position may pass along said mandrel past said second positioning means and toward the end of the mandrel opposing said first end;

(4) third support means for supporting the opposing end of said mandrel in a manner which permits the shifting of said mandrel from said first position to said second position;

(5) retention means for retaining the tile on said mandrel and supporting the line of tile when said mandrel is lifted from a recumbent position;

(6) actuating means for selectively actuating said retention means to and from a retention position and from and to a releasable position whereby said mandrel may be withdrawn from the line of tile after positioning said tile at the pouring station.

7. A method of forming an upstanding runner of refractory tile for receiving molten metal in a bottom-pour casting system, which comprises the steps of:

loading the tile on a mandrel from one end thereof;

threading an expendable load-bearing washer-like element on said mandrel from the other end thereof and releasably attaching said element to said mandrel;

lifting said mandrel with said tile to a substantially vertical position so that the tile is supported by said element;

positioning said tile over a receiving port of the casting system;

releasing said washer-like element from said mandrel; and withdrawing the mandrel while leaving said tile and said element deposited in a vertical stack over said port, without dropping the stack during the withdrawal step.

8. Apparatus for releasably retaining a plurality of refractory tile in linear alignment and for seating the tile over the receiving port of a metal casting system, comprising:

a mandrel for receiving said tile from one end thereof;

a load-bearing washer-like element, having a thickness less than the axial length of said tile;

said element encircling said mandrel and having an outside diameter greater than the inside diameter of said tile and being received on said mandrel from the other end thereof;

retention means, actionable between retention and releasable positions, which when in a retention position retains said element and said tile on said mandrel and which when in a releasable position releases said element and said tile from said mandrel so that said mandrel can be withdrawn through the inside diameter of said element and said tile.

9. Apparatus for releasably retaining a plurality of refractory tile in linear alignment and for seating the tile over the receiving port of a metal casting system comprising:

a hollow mandrel for receiving thereon said tile, said mandrel having a loading end at one end of the longitudinal axis of the mandrel over which the tile are threaded onto the mandrel and an unloading end at the opposite end of the longitudinal axis of the mandrel;

an expendable load-bearing washer-like metal element;

said element encircling said mandrel at its unloading end and having an outside diameter greater than the inside diameter of but less than the outside diameter of said tile;

releasable retention means at the unloading end of the mandrel extending transversely of the longitudinal axis of said mandrel when in the retention position;

the transverse extent of said releasable retention means when in the retention position being beyond the inside diameter of said expendable element so as to retain said expendable element and tile on said mandrel, and the transverse extent of the releasable retention means when in the releasable position being within the inside diameter of said expendable element so as to release said expendable element and tile from said mandrel;

actuating means for actuating said retention means between retention and releasable positions, and actuating means extending from the loading to the unloading ends of said mandrel;

said retention means being arranged in respect to the tile, said expendable element, and said mandrel such that the tile may be seated on said receiving port without dropping.

10. Apparatus as described in claim 9 which further comprises:

a ball-like element at said unloading end of said mandrel for seating in said receiving port.

11. Apparatus as described in claim 9, wherein:

the tile to be positioned adjacent to said unloading end of said mandrel is provided with a recessed end face and said element is positioned against said recessed end face.

* * * * *